US008297621B1

(12) United States Patent
Chao et al.

(10) Patent No.: US 8,297,621 B1
(45) Date of Patent: Oct. 30, 2012

(54) CARD GAME FOR LEARNING AND PRACTICING EXPERIENCE ELEMENTS TO PLAYERS FOR THE MODELS OF BEHAVIORAL AND FINANCIAL SUCCESS

(75) Inventors: Shu Hua Chao, New Taipei (TW); Ching Yen Huang, New Taipei (TW)

(73) Assignee: Chung Hua University, Hsinchu (TW)

( * ) Notice: Subject to any disclaimer, the term of this patent is extended or adjusted under 35 U.S.C. 154(b) by 7 days.

(21) Appl. No.: 13/162,723

(22) Filed: Jun. 17, 2011

(51) Int. Cl.
*A63F 1/02* (2006.01)

(52) U.S. Cl. ..... 273/297

(58) Field of Classification Search ..... 273/297, 273/292

See application file for complete search history.

(56) References Cited

U.S. PATENT DOCUMENTS 6,375,466 B1 * 4/2002 Juranovic ..... 434/107
6,497,410 B1 * 12/2002 Bernstein et al. ..... 273/297

* cited by examiner

*Primary Examiner* — Michael Dennis
(74) *Attorney, Agent, or Firm* — Chun-Ming Shih

(57) ABSTRACT

A card game for teaching skills to players for the models of behavioral and financial success includes a financial center; simulated life event cards; different variable element cards; a plurality of different energy element cards; a plurality of different self energy element cards; and a plurality of different game recordation and learning reports wherein the player can declare a qualifier by reaching a qualified target, any qualifier who self-confident become the winner can declare a state of entering the final decisive contest to challenge the champion and announce how many cycles the competition ended Simultaneously, the final competition period should not be less than three times cycling trough the financial center and the game will be finished after these cycles. Scores of all players will be calculated after end with a genuine winner being declared thereafter. The winner is not only a qualifier but also the genuine victor.

10 Claims, 10 Drawing Sheets health and living quality

| life | athletic | playing | literature | accident | risk |
|---|---|---|---|---|---|
| shopping | dancing | excursion | attending concert | hurt | ill |
| ⋮ | ⋮ | ⋮ | ⋮ | ⋮ | ⋮ |

wealth creation and freedom

| investment | luck | enjoy | living quality | accident | risk |
|---|---|---|---|---|---|
| loan | lottery | gem | buying home | fire | indemnity |
| ⋮ | ⋮ | ⋮ | ⋮ | ⋮ | ⋮ |

society and relationship

| homogeneity | behavior | activity | society | accident | risk |
|---|---|---|---|---|---|
| neighborhood | love | birthday party | donation | burglar loss | bad company |
| ⋮ | ⋮ | ⋮ | ⋮ | ⋮ | ⋮ |

work and venture

| ability | work | venture | luck | accident | risk |
|---|---|---|---|---|---|
| overseas learning | business trip | run small office | mission finish | business end | demotion |
| ⋮ | ⋮ | ⋮ | ⋮ | ⋮ | ⋮ |

FIG. 7 name: occupation: STATEMENT OF FINANCIAL POSITION serial # page

| | | contents | income | | | expense | | | investment management | | | | cash flow | | liabilities |
|---|---|---|---|---|---|---|---|---|---|---|---|---|---|---|---|
| | | serial # | A-1 | A-2 | A-3 | B-1 | | B-2 | C-1 | | C-2 | | D-1 | D-2 | E |
| | year | income details | job income | non-job income | net income | N | fixed expense | other expense | N | investment capital | N | tax interest | operating cost | cash | balance |
| 1 | | | | | | | | | | | | | | | |
| 2 | | | | | | | | | | | | | | | |
| 3 | | | | | | | | | | | | | | | |
| 4 | | | | | | | | | | | | | | | |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 38 | | | | | | | | | | | | | | | |

N: comment

FIG. 9

| wealth target: 50 millions | | | |
|---|---|---|---|
| annual assets | | annual liabilities | balance |
| A=C2+D1+D2 | | B=E | A+B |
| 1 | $250,000 | -$200,000 | $50,000 |
| 2 | $36,000 | -$50,000 | -$14,000 |
| 3 | $80,000 | -$50,000 | $30,000 |
| ⋮ | ⋮ | ⋮ | ⋮ |
| 23 | ⋮ | ⋮ | $30,000,000 |
| total | 30,000,000 / 50,000,000 x 100 = | | |

FIG. 10

Energy elements

S: Selection energy element
Q: Quality energy element
O: Opportunity energy element
A: Ability energy element
P: Suporter energy element
T: Thanks giving energy element Self - Energy elements life event
learning
management
integration
innovation

CARD GAME FOR LEARNING AND PRACTICING EXPERIENCE ELEMENTS TO PLAYERS FOR THE MODELS OF BEHAVIORAL AND FINANCIAL SUCCESS

BACKGROUND OF THE INVENTION

1. Field of the Invention

The present invention relates to the art of card games and, more particularly, to a card game for learning and practicing experience elements to players for the models of behavioral and financial success.

2. Description of the Related Art

Card game is a game in which cards are placed, removed, or moved on a card according to a set of rules. Games may be based on pure strategy, chance or a mixture of the two and usually have a goal which a player aims to achieve. Most current card games are based on beating opposing players in terms of counters, winning position or accrual of points often expressed as in-game currency.

There are many different types and styles of board games such as CASHFLOW.

It is typical in a board game that a player throws dice to see which integer (e.g., one to six) is on top. Next, the player may move a card a number of steps forward depending on the integer. The deciding role of such board game is the dice not the player. Thus, it is more entertainment oriented rather than teaching oriented in nature. Content of the board game is limited by board design and opportunities. Also, only forward and backward movements are allowed by the rules of the game. A given player wins the game if, for example, after all the players' dreams have been purchased, the given player is the only person who has obtained his/her chosen dream. Its ending is almost predictable. Interactions between players are minimized. Players may learn little of fundamental aspects of personal finance, investing and accounting. It is neither interesting nor full of teaching. Thus, the need for improvement still exists.

SUMMARY OF THE INVENTION

It is therefore one object of the invention to provide a card game for learning and practicing experience elements to players for the models of behavioral and financial success, comprising a financial center as an operating center of the card game for setting initial conditions of each player, setting playing time, setting economic market status, setting final target, calculating tables and lists, setting financial markets, setting consumer markets, issuing payment, and issuing year-end performance-related pay; a plurality of simulated life event cards including events related to at least health, society, career, and wealth, the events being either independent or affecting one another, the event being a simulated event about daily life, and the event being adapted to set payment and earning of each player when playing the card game wherein the life event cards are randomly issued to the players when the card game begins, one player can execute any life event card, and the other players can join the executed life event card or not that may change the financial status of those following players; a plurality of different variable element cards each for changing the life event card, the variable element card adapted to change, exchange, and replace the life event cards of the players, and change required payments and earning of the life event cards wherein the variable element cards and the life event cards are mixed and randomly distributed to each player when the card game begins, one player can execute any variable element card for change, and the other players have to execute events given by the executed variable element card and change the life event cards or combine the life event cards of the players; a plurality of different energy element cards each corresponding to the required payment and earning of the life event card wherein a set of the energy element cards are distributed to each player when the card game begins, and each player can execute any event by sending or receiving the energy element card; and a plurality of different game recordation and learning reports generated by the player executing the life event card, paying the required payment, and obtaining the earning wherein the player can declare a qualifier by reaching a qualified target, any qualifier who self-confident become the winner can declare a state of entering the final decisive contest to challenge the champion and announce how many cycles the competition ended Simultaneously, the final competition period should not be less than three times cycling trough the financial center and the game will be finished after those cycles. Scores of all players will be calculated after ending with a genuine winner being declared thereafter. The winner is not only a qualifier but also the genuine victor.

In a first aspect of the invention the life event cards comprise (a) events related to life, athletics, entertainment, literature, accident, and risk of health; (b) events related to homogeneity, behavior, activities, society, accident, and risk of society; (c) events related to ability, job, business, opportunity, accident, and risk of career; and (d) events related to wealth, investment and luck, enjoyment, property, quality, accident, and risk of wealth.

In a second aspect of the invention the variable element cards comprise an opportunity variable element card to changing life event card from player; A transfer card for allowing all player to transfer life event cards by rules; a power and influence card for allowing one player to check cards owned by the other players and take out one card from one of the other players, the power and influence card being a "must" of the life event card; a destiny card for allowing one player to take out a card from the remaining life event cards not given to the players, the destiny card being a "no control" card required to execute immediately without delay; not only one solution card for solving problems by asking the financial center or the other players; a really lucky card for getting a chance to substitute one card from the remaining life event cards not given to the players, the really lucky card being adapted to exchange with any cards not wanted by a player; an exchange card for allowing all player to exchange an unwanted life event card with next player mutually; a double repayment card being positive and negative selections for increasing effects of good and bad events respectively, the double repayment card being adapted to double the payment or the earning; and a help card for helping other players in need.

In a third aspect of the invention the energy element cards comprise environment energy element cards for interacting with the environment, self energy cards for learning and management developing integration and innovation, dynamic energy element cards for changing speed of life events, and opportunity energy cards for competing and taking opportunities by obtaining, negotiating, or communicating.

In a fourth aspect of the invention the environment energy element cards comprise selection cards for representing obtainment or rejection, opportunity cards for representing chasing and control, ability cards for representing ability promotion and enhancement, quality cards for representing enjoyment and innovation, supporter cards for representing support and help, and thanks giving cards for representing acknowledgement and preciousness.

In a fifth aspect of the invention the self energy cards comprise learning cards for representing self growth, management cards for representing ability of managing learning result, integration cards for representing progress after the management, and innovation cards for representing differences made after the integration, and wherein the self energy cards are derived from the environment energy element cards and are sequentially obtained.

In a sixth aspect of the invention the dynamic energy element cards comprise positive cards for representing desire, chasing cards for representing fervor, target card for representing target, competition cards for representing competition and challenge, help cards for representing asking help, and risk cards for representing challenge in a risky environment.

In a seventh aspect of the invention the opportunity energy element cards comprise, sequentially, want cards for representing a player wanting another player to share or assign a life event card when seeing an opportunity, must cards for representing requesting another player to transfer his or her life event card, and bidding cards for representing requesting another player to bid investment or business; wherein the bidding card has a higher priority than the must card and the must card priority than the want card, when the players are playing the opportunity energy element cards at the same; and wherein the highest priority will be decided by bidding if more than two players play the same cards at the same time.

In an eighth aspect of the invention the game recordation report and learning reports comprise a statement of cash flows, an investment statement, an asset and liability state, an energy development table, a corporate financial report, a personal bank balance statement, a risk management, a target set dream table, a personality analysis, and a success program.

In a ninth aspect of the invention the financial center can declare the market status having (A) a current market value wherein different risks can be shown by adding plus or minus percentage of market value to initial value, the accumulated value is taken as the current market value and is represented by different colors each being associated with a digit representing degree of risk; (B) an economical circulation wherein an economical digit machine can randomly show a positive or negative integer for representing economical boom or bust, and wherein the positive integer means economic is growing and the negative integer means economic is in recession, or the economical circulation is represented by the current market value and represented by digits; and (C) a risk coefficient representing corresponding coefficient of one of different financial products or businesses wherein the risk coefficient is subject to market variations and can be obtained by simulating real market; wherein each financial product can be expressed by (A)×(B)×(C) which is equal to up or down percentage of the financial product of current year so that risks of different financial products can be represented by a three-dimensional structure to enable the players to easily learn variation models of a real financial market.

BRIEF DESCRIPTION OF THE DRAWINGS

The invention, as well as its many advantages, may be further understood by the following detailed description and drawings in which:

FIG. 7 is a database of a number of events about life;

FIG. 9 is a table of statement of cash flows according to income and outcome of the invention;

FIG. 10 is a table of balance sheet according to the invention; and

DETAILED DESCRIPTION OF THE INVENTION

Figure 1:
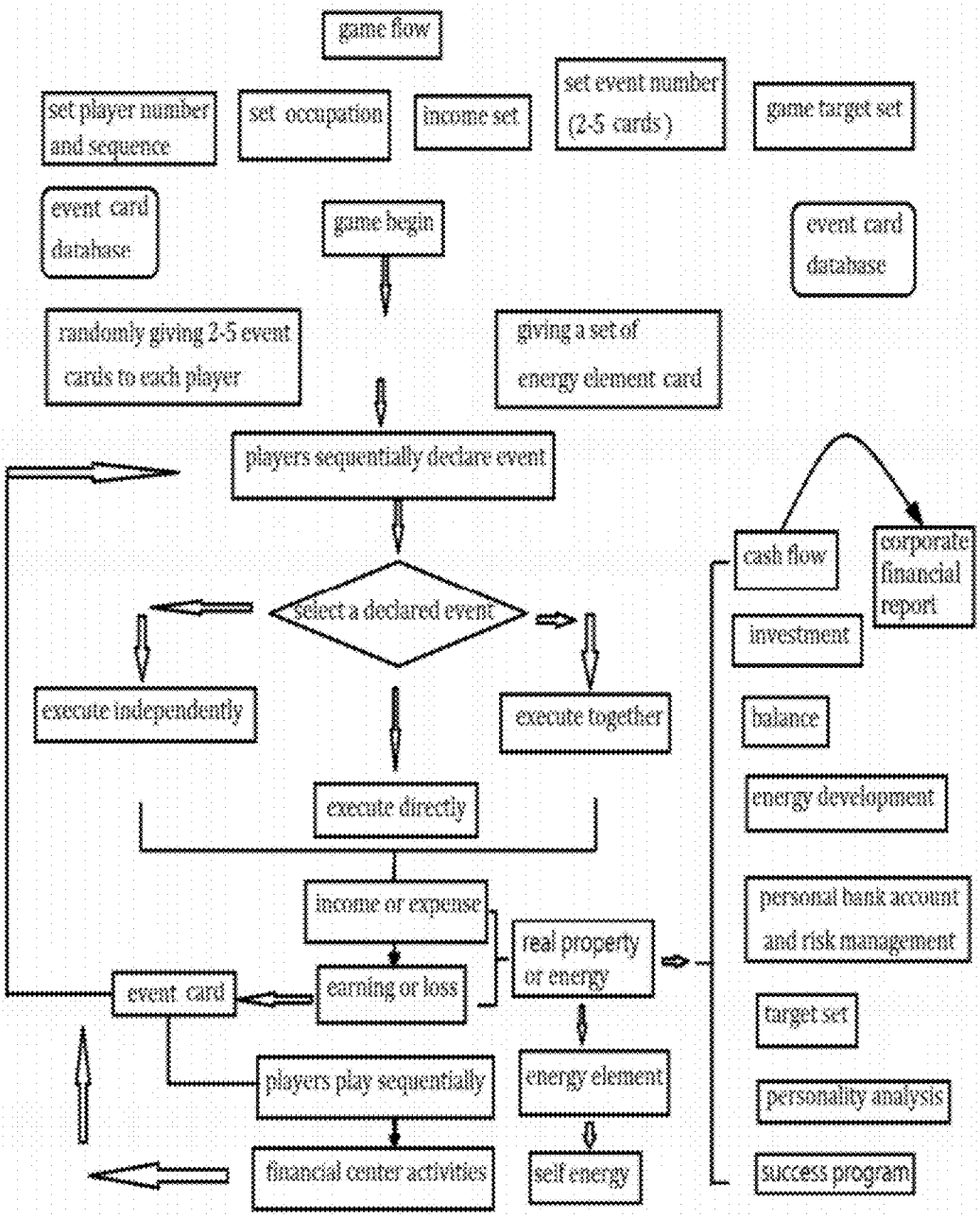
FIG. 1 is a flow chart of a card game for learning and practicing experience elements to players for the models of behavioral and financial success according to the invention.
Figure 2:
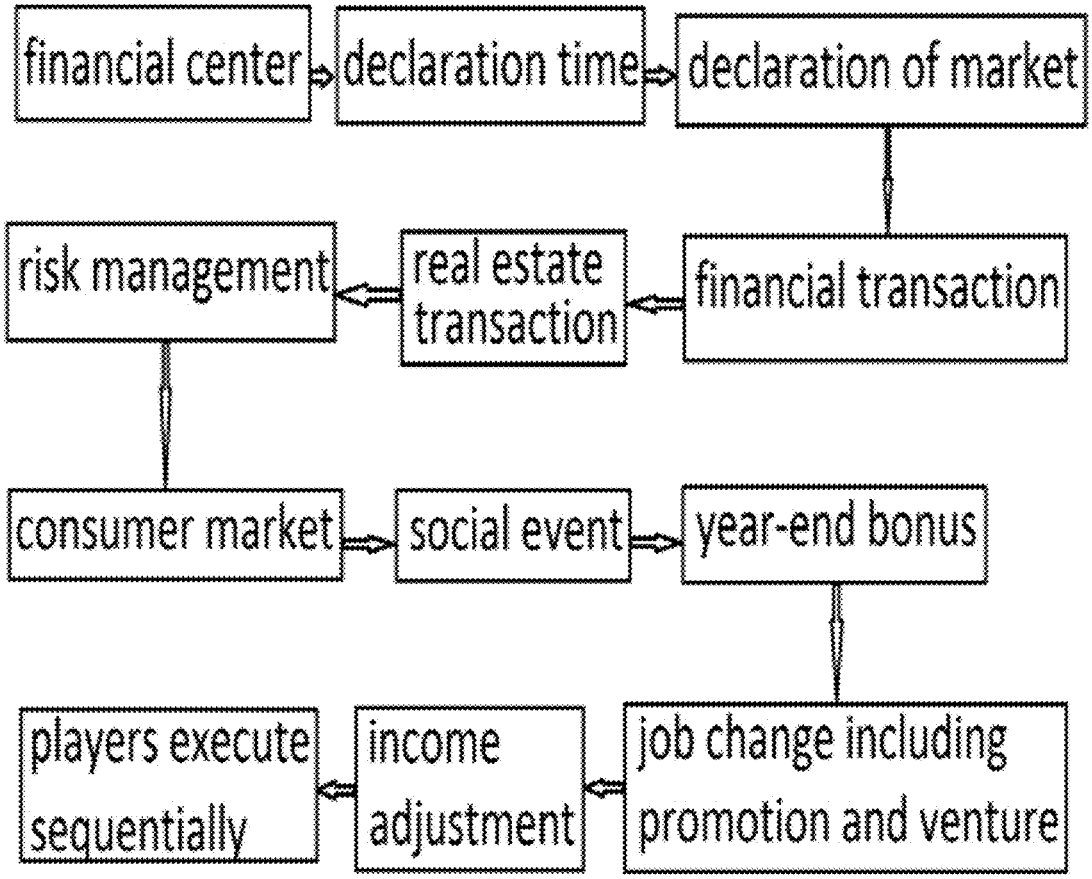
FIG. 2 is a flow chart of the financial center.
Figure 3:
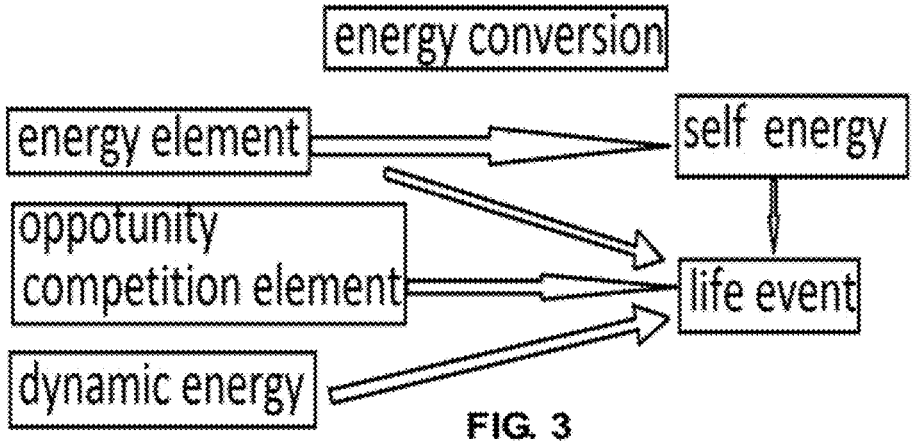
FIG. 3 is a flow chart of the energy conversion.
Figure 4:
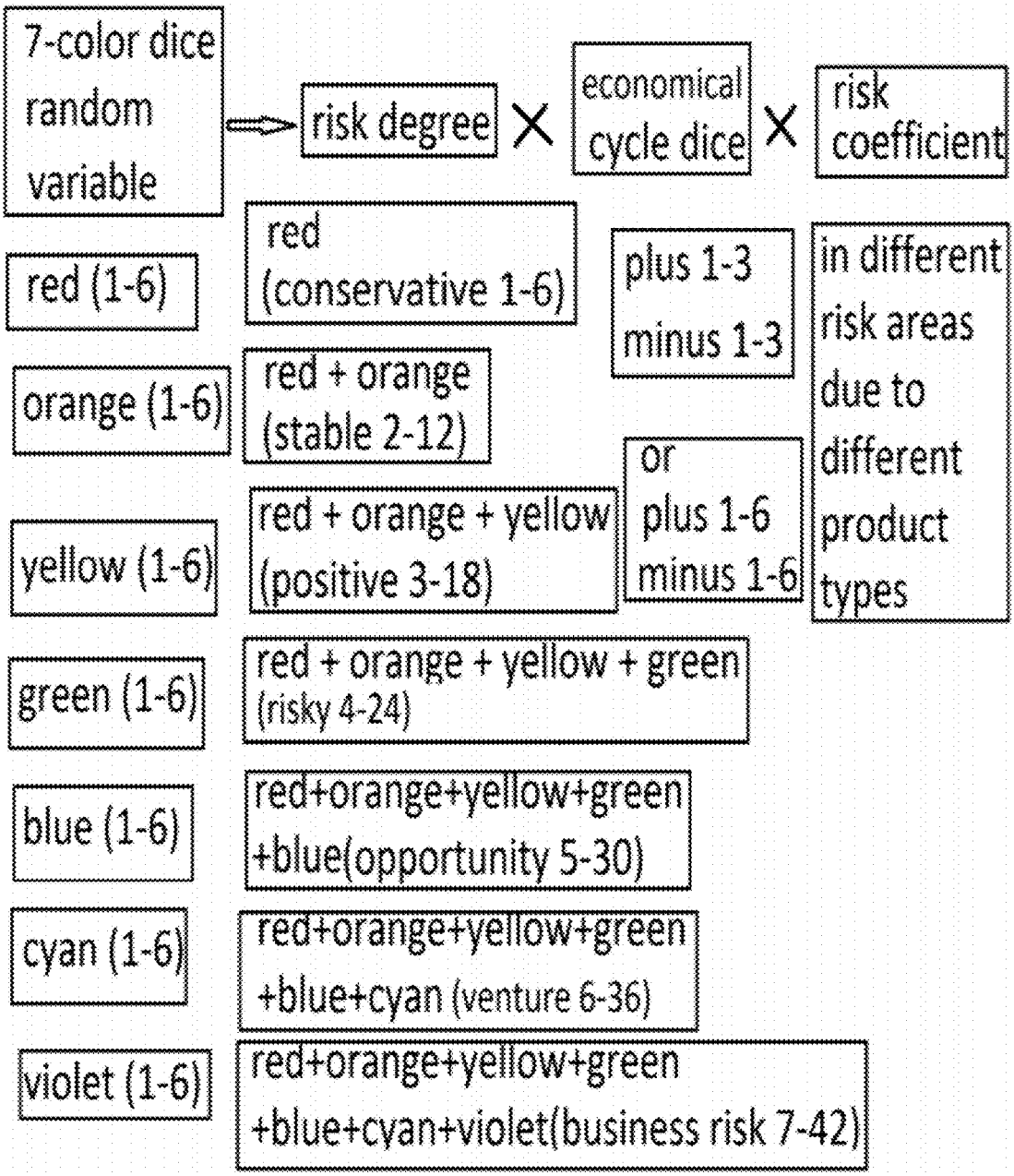
FIG. 4 is a flow chart of the economic market risk degree.
Figure 5:
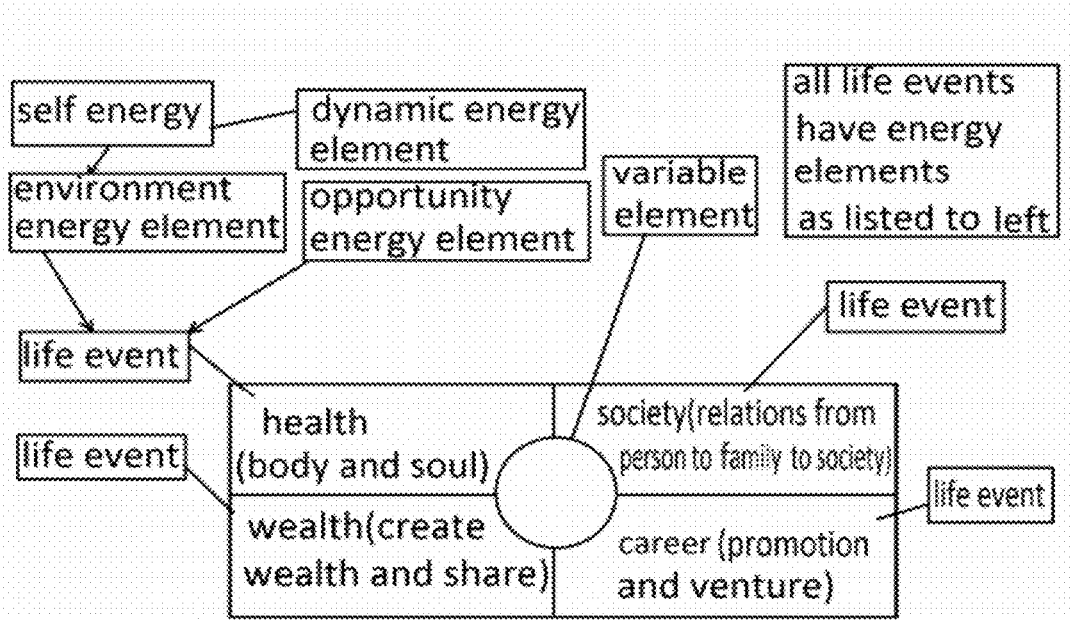
FIG. 5 schematically depicts system components of the invention.
Figure 6:
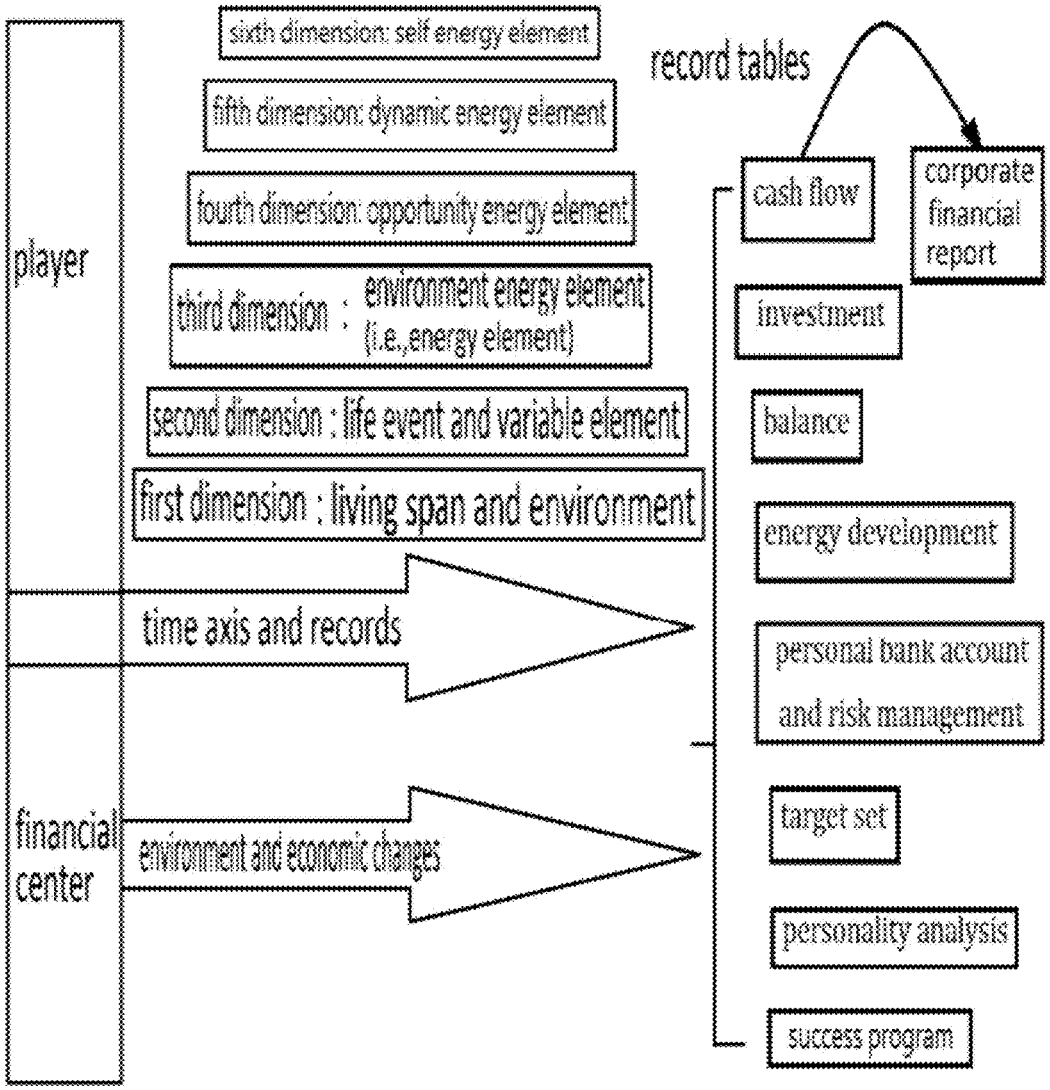
FIG. 6 is a detailed diagram of FIG. 5.
Figure 8:
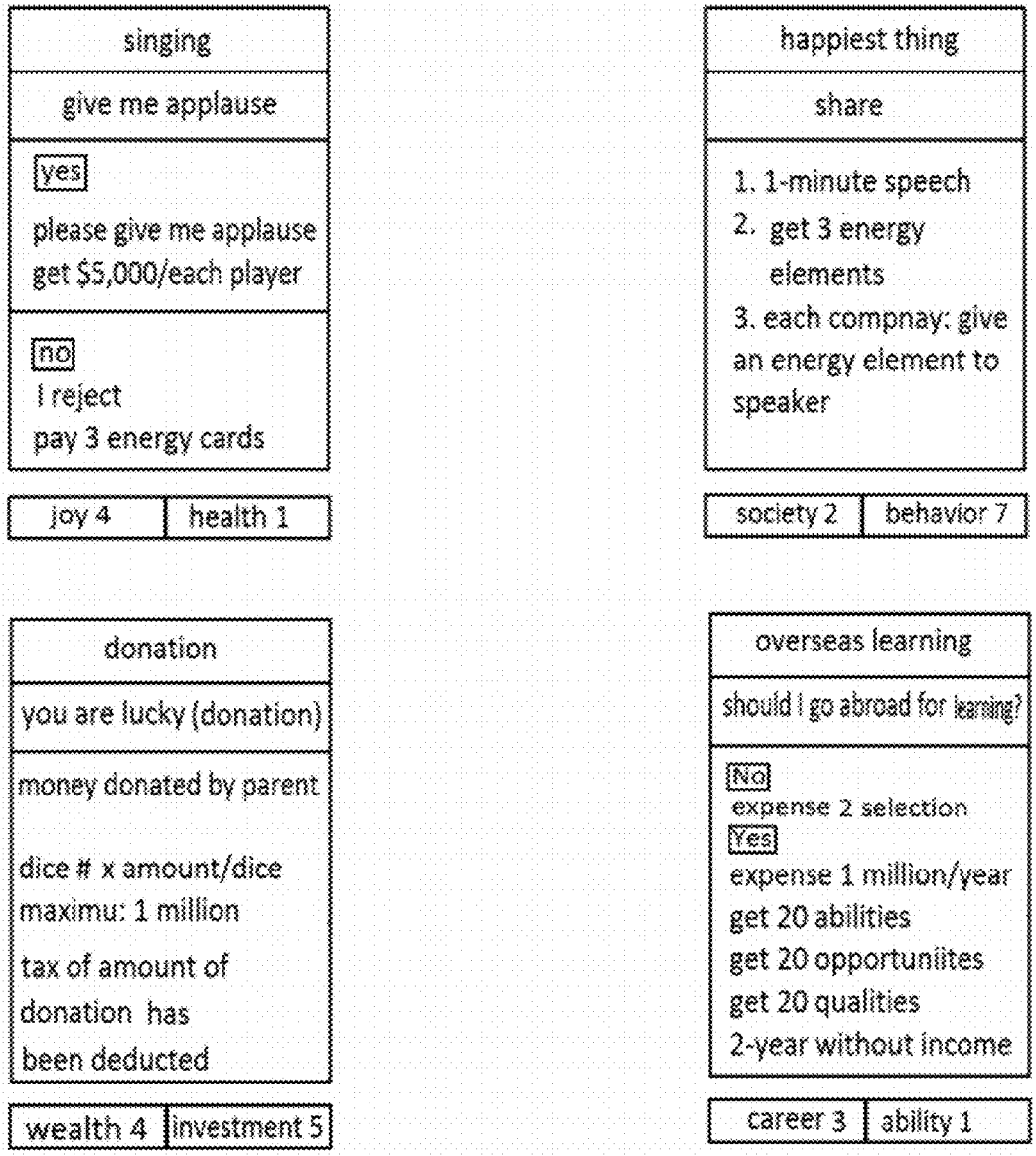
FIG. 8 is a table of a number of exemplary examples of FIG. 7.

Referring to FIGS. 1 to 11, a card game for learning and practicing experience elements to players for the models of behavioral and financial success according to the invention is shown and comprises the following components as detailed below.

A financial center is an operating center of the card game. The financial center may set initial conditions of each player, set playing time, set economic market status, set final target, calculate tables and lists, set financial markets, set consumer markets, issue payment, and issue year-end performance-related pay. A plurality of simulated life event cards includes events related to health, society, career, wealth, etc. The events may be independent or affect one another. The event may be a simulated event about daily life. The event may set payment and earning of each player when playing the card game. The life event cards are issued to players randomly when the card game begins. A player may execute any life event card as he/she wishes. Other players may join the executed life event card or not that may change the financial status of those following players. A plurality of different variable element cards each may change distribution status of the life event cards. Also, the variable element card may change, exchange, and replace the life event cards of the players. Further, the variable element card may change the required payments and earning of the life event cards. The variable element cards and the life event cards are mixed and randomly distributed to each player when the card game begins. A player may execute any desired variable element card for change and the remaining players have to execute events given by the executed variable element card and transfer the life event cards or exchange the life event cards owned by the players. A plurality of different energy element cards each corresponds to the required payment and earning of the life event card. A set of energy element cards are distributed to each player. Each player may execute an event by sending or receiving an energy element card. A plurality of different self energy element cards each corresponds to the energy element card. The self energy element card is the most important one for scoring. A plurality of different game recordation and learning reports are provided. A player may generate a plurality of different game recordation and learning reports by executing the life event card and paying the required payment and obtaining the earning. A qualifier by reaching a qualified target, any qualifier who self-confident become the winner can declare a state of entering the final decisive contest to challenge the champion and announce how many cycles the competition ended Simultaneously, the final competition period should not be less than three times cycling trough the financial center and the game will be finished after those cycles. Scores of all players will be calculated after ending with a genuine winner being declared thereafter. The winner is not only a qualifier but also the genuine victor.

A life event card may be a life event card related to life, athletics, entertainment, literature, accident, risks, etc. A life event card may be a social life event card related to homogeneity, behavior, activities, society, accident, risk, etc. A life event card may be a career life event card related to ability, job, business, opportunity, accident, risk, etc. A life event card may be a wealth life event card related to investment and luck, enjoyment, property, quality, accident, risk, etc. The numbers of the life event cards belonging to different categories are different. This means that opportunities, risks, and accidents of the different life event cards are different in terms of probability. There is a plurality of combinations of life event cards corresponding to a number of players. This means that probability of repeat of one event is equal to that of another event. Luck does not play a role in deciding which cards will go to a given player. Hence, players have the right to decide what is going on next in the card game.

A variable element card may be an opportunity variable element card to change a life event card into an opportunity one. A transfer card for allowing all player to transfer life event cards by rules; a power and influence card for allowing one player to check cards owned by the other players and take out one card from one of the other players, the power and influence card being a "must" of the life event card; a destiny card for allowing one player to take out a card from the remaining life event cards not given to the players, the destiny card being a "no control" card required to execute immediately without delay; not only one solution card for solving problems by asking the financial center or the player; a really lucky card for getting a chance to substitute one card from the remaining life event cards not given to the players, the really lucky card being adapted to exchange with any cards not wanted by a player; an exchange card for allowing all player to exchange an unwanted life event card with next player mutually; a double repayment card being positive and negative selections for increasing effects of good and bad events respectively, the double repayment card being adapted to double the payment or the earning; and a help card for helping other players in need.

The energy element cards comprise environment energy element cards for interacting with the environment, self energy cards for learning and management developing integration and innovation, dynamic energy element cards for changing the speed of life events, and opportunity energy cards for competing and taking opportunities by obtaining, negotiating, or communicating.

The environment energy element cards comprise selection cards for representing obtainment or rejection, opportunity cards for representing chasing and control, ability cards for representing ability promotion and enhancement, quality cards for representing enjoyment and innovation, supporter cards for representing support and help, and thanks giving cards for representing acknowledgement and preciousness.

The self energy cards comprise learning cards for representing self growth, management cards for representing ability of managing learning result, integration cards for representing progress after the management, and innovation cards for representing differences made after the integration. The self energy cards are derived from the environment energy element cards and are sequentially obtained.

The dynamic energy element cards comprise positive cards for representing desire, chasing cards for representing fervor, target card for representing target, competition cards for representing competition and challenge, help cards for representing asking help, and risk cards for representing challenge in a risky environment.

The opportunity energy element cards comprise, sequentially, want cards for representing a player wanting another player to share or assign a life event card when seeing an opportunity (e.g., house purchase or investment), must cards for representing requesting another player to transfer his/her life event card, and bidding cards for representing requesting another player to bid investment or business. The bidding card has a higher priority than the must card and the must card priority than the want card when a plurality of player playing the opportunity energy element cards at the same. The highest priority will be decided by bidding if more than two players play the same cards at the same time.

The game recordation and learning reports comprise statement of cash flows, investment statement, asset and liability state, energy development table, corporate financial report, personal bank balance statement, risk management, target set dream table, personality analysis, and success program.

PREFERRED EMBODIMENT 1

The financial center is the center of the market and the power house of the card game. Main functions of the financial center comprise the following depending on game level and conditions:

(I). Time Declaration

Time length is one year for one cycle of departing from the financial center to returning thereto. Time length may be decrease to six-month, three-month, one month, or one week depending on the game level. The shorter of the time length means the higher of the strategy and technology level.

(II). Details of a Player

Age, occupation, income, and expenses of a player are set. In detail, (2-1) On an occupation card there are provided occupation, salary for new corners, salary for experienced, salary being fixed or having performance-related pay which is either base salary plus performance-related pay or performance-related pay only, energy cards that can increase salary, and energy cards that can increase ranks. Working experience time period or given energy cards can increase a player's salary to be equal to that of an experienced player. Giving energy cards can increase ranks. However, higher management posts are only available when there is vacancy or required energy cards are given. (2-2) There are A, B, C, D and E Fixed expenditure percentages from income in which Fixed expenditure percentage A is 90%, B is 70%, C is 60%, D is 50%, and E is 40%. Fixed expenditure percentages A and B are high Fixed expenditure so that different quality energy cards are given to them that means the expenditure trades the quality and that D and E are low Fixed expenditure that means economizes loses the quality so that they have to pay different quality energy cards. Both above A, B, D, and E Fixed expenditure percentages and energy cards giving or taking may be changed by learning.

Fixed expenditure percentages of all players in a fixed expenditure percentages card obtained from a first round drawing are equal. All players are allowed to increase his/her salary, change job, and change one of A, B, C, D and E fixed expenditure percentages by considering owned energy cards.

Rank increase, salary increase, job change, and income and expense changes of a player depend on his/her energy cards, markets and opportunities.

(III). Declaration of Market Status (A) Current market value: Different risks can be shown by adding plus or minus percentage of market value to initial condition. The accumulated value is taken as current market value and is represented by different colors machine. For example, the colors are printed on a dice and comprise red, orange, yellow, green, blue, cyan, and violet which mean conservative, stable, positive, risky, opportunity, venture, and business risk respectively. Red plus one or more next color means more risky. For example, red means conservative, red plus orange means stable, red plus orange plus yellow means positive, red plus orange plus yellow plus green means opportunity, red plus orange plus yellow plus green plus blue means risky, red plus orange plus yellow plus green plus yellow plus blue plus cyan means venture, and red plus orange plus yellow plus green plus yellow plus blue plus cyan plus violet means business risk. The more of the number of colors the more risky (i.e., as well as higher profit) it will be.

(B) Economical circulation: Economical digit machine may show a number for representing the economic degree, the degree showed by plus or minus, or economical dice plus or minus 3 or plus or minus 6 representing economic boom or bust. Plus means economic is growing and minus means economic is in recession. Alternatively, economical circulation is represented by current market value and represented by digits.

(C) Risk coefficient represents corresponding coefficient of one of different financial products or businesses. Risk coefficient is subject to market variations and can be obtained by simulating real market. For example, funds, stocks, and real estate have different risk coefficients which are different in different countries and can be set by the market.

Each financial product can be expressed by (A)×(B)×(C) which is equal to up or down percentage of the financial product of the current year. Thus, risks of different financial products can be represented by a three-dimensional structure. This enables a player to easily learn variation models of a real financial market.

(IV). Investments

There are many investments provided by the financial center and their conditions are much better than general investments of the life event cards.

(V). Sales

There is a plurality of products to be sold. For example, financial products, insurance, loans, ventures, corporate acquisitions, and real estate are provided by the financial center and are time set by same. For instance, in credit card issuance every ability card can increase credit equal to monthly salary. For loan, for giving an ability card and a selection card as a set, each set enables a player to get loan equal to ten times monthly salary with at most five loans being allowed. Interest rates are divided into A, B, C, D and E levels in which A level is 18%, B level is 15%, C level is 10%, D level is 5% and E level is 2%. Rate will be lowered one level for each addition of an ability card. Alternatively, the A, B, C, D and E levels of interest rate can be set depending on local financial status.

(VI). Opportunity and Luck

A player may draw a mixing happy card, opportunity card, or a society event card for obtaining the opportunity of lottery, job change, shopping, venture opportunity, real estate opportunity, investment market, preferential loans, and salary increase. This event is independent of business cycle.

(VII). Accounts Payable

This comprises loans, insurance, investments, lending, corporate accounts payable, and court rulings etc.

(VIII). Calculation

Each player is required to fill the following statements, etc. depending on game levels: Statement of cash flows, investment report, balance sheet, energy development table, corporate financial report, personal bank account and risk management, target set table, personality analysis table, and success program.

(IX). Year-end performance-related pay

Year-end performance-related pay will be drawn by the financial center and distributed to each player as year-end performance-related pay which is subject to variations depending on business leading indicator, occupation and given energy card.

(X). Annual Salary is Given by Cash after Deducting Fixed Expenditure.

Rules of Game

Financial center is the operating center of the game which is divided into different levels. All games have the same structures but different levels. The number of levels is 10 from basic to advance.

(1) Game Target Set

Game target for qualified based on learning purposes is required to set before the game begins. For example, It includes time of 10 years with each cycle representing one year; wealth worth of 10 million dollars or annual income of one million dollars (or business representing the highest ranking management post, annual income of two million dollars, or investment of five million dollars), etc; and energy development table showing a score of at least 60 in each of health, society, career and wealth fields with 100 being the highest score. Energy development table is the most important score table. Different scores in the boxes (see FIG. 11) mean capabilities of development and key scores. Area sizes can also show different icons in each field.

During the time of period it may have many players reaching the target, those players can be declared as a qualifier if passing the above criteria. Any qualifier can challenge as a winner if he/she is confident after reaching the target. The declarer also should declare the competition time. The competition time should not be less than three times cycling trough the financial center and the game will be finished after these cycles. Scores of all players will be calculated after ending with a genuine winner being declared thereafter. During these three cycles the challenger may be surmounted by other players in any time since both opportunities and risks exist. Thus, any player should be cautious about challenge winner declaration.

(2) Statement and table selections

A player may select a desired statement or table based on learning purposes or generates same.

(A) The following statements and tables belong to flow chart for analysis with no score being recorded: Statement of cash flows, corporate financial report, investment report, personality analysis table, and success program in which statement of cash flows, corporate financial report, and investment report are basic tables, and personality analysis table and success program are special tables.

(B) The following statements and tables belong to result recordation for scoring purposes: Balance sheet, energy development table, personal bank account and risk management, and target set table in which balance sheet and energy development table are basic table, and personal bank account and risk management and target set table are special tables. Scoring method will be decided based on learning purposes. Average score versus time will be chosen as scoring method if no specific purpose is addressed.

(3) Game Start (3-1) Initial conditions will be set by the financial center prior to the beginning of the game. Next, all players register his/her occupation, income, expenses and balance in terms of year or month.

Figure 11:
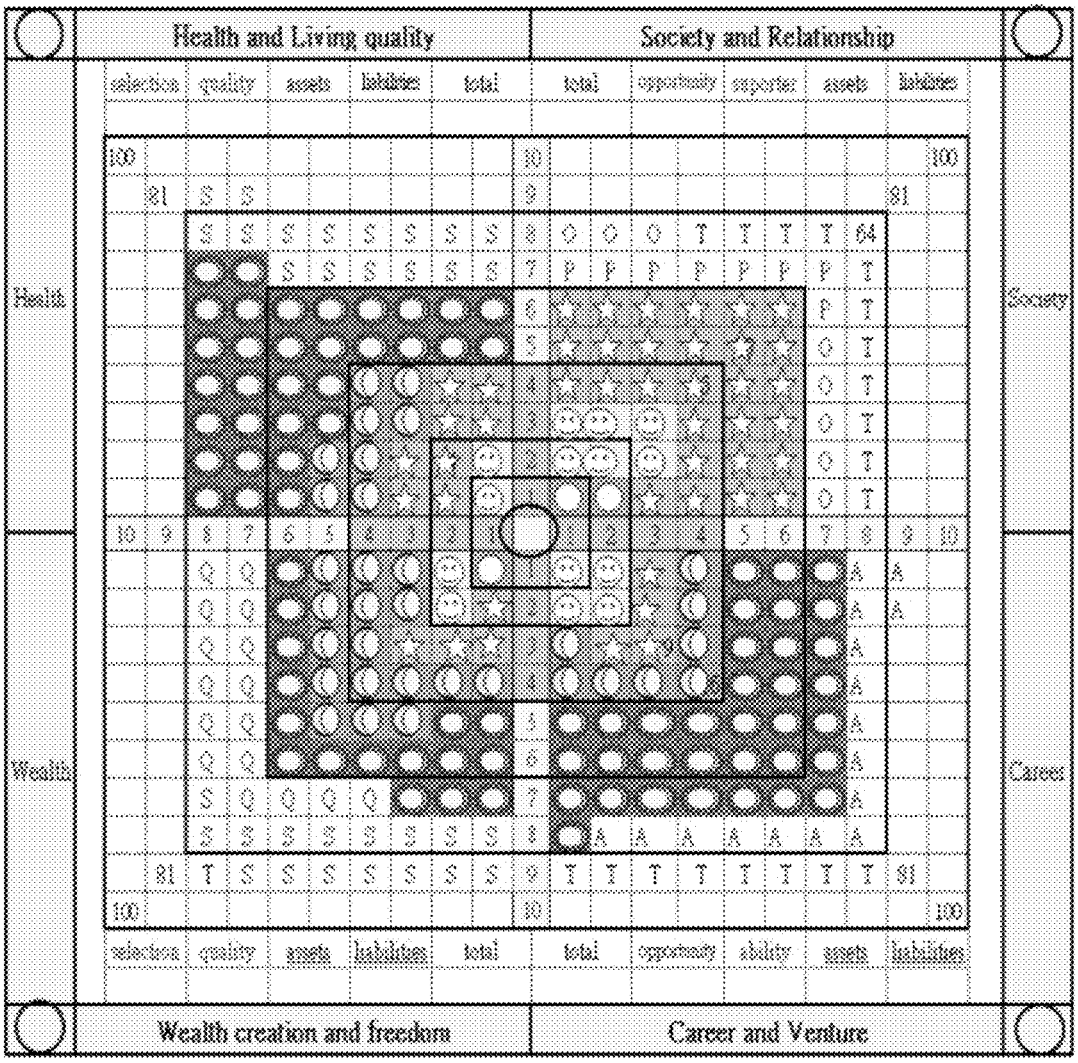
FIG. 11 is a detailed diagram of an exemplary example of health, society, career, wealth, and other factors in an event of FIG. 7.

(3-2) A set of event cards and a set of energy cards are given to each player in which dynamic energy card and opportunity card are used for high level games. The number of cards in the set is determined by game level. Details of an event card are follows. Contents of an event. Method of executing an event. For example, it includes right of selecting to execute or not, required to execute, or companies allowed or not. Cost of event execution, i.e., money, real property, or energy element cards. Payment after event execution, i.e., money, real property, or energy element cards. Values are not fixed, i.e., some values are variables. A number of digit machines which can be a dice or a digit machine will be set by the rules of game. The values of the digits will be accumulated. Numeric units are set as hundred, thousand, ten thousands, hundred thousand, million and ten million. Group games will be decided by a number of integer dices and a numeric unit dice. Which field (e.g., health) and category (e.g., entertainment) of each event card will be indicated? One score will be recorded for the occurrence of each event. After giving a card a player has to fill the cell of the energy development table with a corresponding score. Profile of the table can be shown by viewing the values in the cells. Thus, development can be determined Players holding self energy element cards may record scores by multiplying with the number of self energy element cards. A set of environment energy element cards (i.e., energy element cards) comprises selection including competing for what you want and rejecting what you do not want; opportunity including chasing goal and mission, and owning execution capability and having perseverance; ability including demonstrating personal charm and achievement, and increasing valor; quality including enjoying life and innovation having execution capability and making dream come true; supporter card, giving thanks to supporter and helping each other; thanks giving card, giving thanks to those who help you; and valuing precious things. Energy element cards are unnamed but thanks giving cards are named. A player may give a thanks giving card to another player who gives help during the game. Thanks giving card of the player who asks for help does not count a score. But the thanks giving card of the player who giving help is counted as a score of 20. The score can be filled in any field. As (T) shown in FIG. 11, energy element cards are not counted as score during the game. A specific number of given energy element cards can be replaced with a number of self energy element cards in the field of health, society, career, wealth individually. The score of the self energy element card is counted by levels. An energy element card can be given to a specific field as score. An energy element card represents score one or two decided by the financial center. The key of winning the game is the score counting of the self energy element cards. The score is counted by multiplication of geometric progression and is seen as the fastest way of increasing score. For a self energy element card, only one field can be chosen at one time That is, a new self energy element card can be purchased after score counting. A self energy element card is divided into levels. The financial center may change multiplication of an event depending on playing time. Each player may obtain a self energy element card by giving a number of energy element cards. For a life field, only one energy element card can be used for increasing score. A player may have four self energy element cards in different fields for development. A player may refer to energy development table for details about specific energy element cards. T hanks giving cards with score 20 of other players cannot be multiplied each other. Thanks giving cards with score 20 may be distributed in different fields. A player may have substitute five different energy element cards with a learning card. Each event is doubled in scoring after having the learning card. The learning card is represented by smiling. A player may substitute a learning card and five same energy element cards with a management card. Score of the management card is counted four times for each event. The management card is represented by star. A player may substitute a management card and five different energy element cards of specific fields with an integration card. Score of the integration card is counted eight times for each event. The integration card is represented by moon. A player may substitute an integration card and five different energy element cards of specific fields with an innovation card. Score of the innovation card is counted 16 times for each event. The innovation card is represented by sun. Details of field specific energy element cards are shown in FIG. 11. Dynamic energy element cards and opportunity cards are used in high level games. Each player will be given a set of different dynamic energy element cards and opportunity cards. A player may take any chances to obtain the greatest score.

(3-3) Each player may give a card by observing a passing event by considering the maximum earning and the minimum loss in turn. The player may execute the given card. Details of the event executions by the players are recorded in the statement of cash flows. Players having business may additionally fill the corporate finance report. Score will be counted in a field corresponding to the card given by a player. Score will be doubled if it is a self energy element card. Score will be updated in the energy development table after card giving. Then a new life event card will be given to the player.

(3-4) A variable element card may be mixed in the life event cards for arranging or changing life event cards owned by all players. For instance, "transfer" means luck transfer, "power and influence" means influence of evil force, "destiny" means no control, "not only one solution" means problem can be solved by many ways, "really lucky" means get a chance has another better choice, "exchange" means considering others' situation that may happen to you, "double repayment" means sometimes results are enhanced whatever positive or negative, and "help" means helping others. All factors that may change a life element or a life event may be added.

(3-5) Financial center may draw occupation and a game with different levels in a random manner. Basically, annual income and fixed expenditure percentage of all players are the same in the first year. Financial center may record same in the statement of cash flows. The financial center may pay salary whenever the money comes to it. It is paid by year if it is an annual salary or by month if it is a monthly salary. All statements and tables are issued at the end of year.

The financial center may adjust the flow chart thereof. The adjustments comprise the following:

1). Time Declaration.

Basically, a cycle of returning to the financial center is one year. The time period may be less than one year, such as six-month, quarter, month and week if the game level is higher. The shorter of the time period of a cycle means better performance (i.e., short time but higher strategy and technology)

2). Declaration of personal data. It comprises age, occupation, income, and fixed expenditures of each player as detailed below. (2-1) On an occupation card there are provided occupation, salary for new corners, salary for experienced, salary being fixed or having performance-related pay which is either base salary plus performance-related pay or performance-related pay only, energy cards that can increase salary, and energy cards that can increase ranks. Working experience time period or pay energy cards can increase a player's salary to be equal to that of an experienced player. Pay energy cards can increase ranks. However, higher management posts are only available when there is vacancy or required energy cards are paid. (2-2) There are A, B, C, D and E fixed expenditure percentages from income in which fixed expenditure percentage A is 90%, B is 70%, C is 60%, D is 50%, and E is 40%. fixed expenditure percentages A and B are high fixed expenditure means life have quality so that different quality energy cards are given to them and that D and E are low fixed expenditure means life have no quality so that they have to pay different quality energy cards. Both above A, B, C, D and E fixed expenditure percentages and energy cards giving or taking may be changed by learning.

Fixed expenditure percentages of all players in a fixed expenditure percentages card obtained from a first round drawing are equal. All players are allowed to increase his/her salary, change job, and change one of A, B, C, D and E fixed expenditure percentages by considering owned energy cards. Official rank increase, salary increase, job change, and income and expense changes of a player depend on his/her energy cards, markets and opportunities.

3). Declaration of Market Status (A) Current market value: Different risks can be shown by adding plus or minus percentage of market value to initial condition. The accumulated value is taken as current market value and is represented by different colors. For example, the colors are printed on a dice and comprise red, orange, yellow, green, blue, cyan, and violet which mean conservative, stable, positive, risky, opportunity, venture, and business risk respectively. Red plus one or more next color means more risky. For example, red means conservative, red plus orange means stable, red plus orange plus yellow means positive, red plus orange plus yellow plus green means opportunity, red plus orange plus yellow plus green plus blue means risky, red plus orange plus yellow plus green plus yellow plus blue plus cyan means venture, and red plus orange plus yellow plus green plus yellow plus blue plus cyan plus violet means business. The more of the number of colors the more risky (i.e., as well as higher profit) it will be.

(B) Economical circulation: Economical digit machine plus or minus, or economical dice plus or minus 3 or plus or minus 6 represents economical boom or bust. Plus means economic is growing and minus means economic is in recession. Alternatively, economical circulation is represented by current market value and represented by digits.

(C) Risk coefficient represents corresponding coefficient of one of different financial products or businesses. Risk coefficient is subject to market variations and can be obtained by simulating real market. For example, funds, stocks, and real estate have different risk coefficients which are different in different countries and can be set by the market.

Each financial product can be expressed by (A)×(B)×(C) which is equal to up or down percentage of the financial product of the current year. Thus, risks of different financial products can be represented by a three-dimensional structure. This enables a player to easily learn variation models of a real financial market.

4). Investments

There are many investments provided by the financial center and their conditions are much better than the general investments in the life event cards.

5). Sales

There is a plurality of products to be sold. For example, financial products, insurance, loans, ventures, corporate acquisitions, and real estate are provided by the financial center and are time set by same. For instance, in credit card issuance every ability card can increase credit equal to monthly salary. For loan, for giving an ability card and a selection card as a set, each set enables a player to get loan equal to ten times monthly salary with at most five loans being allowed. Interest rates are divided into A, B, C, D and E levels in which A level is 18%, B level is 15%, C level is 10%, D level is 5% and E level is 2%. Rate will be lowered one level for each addition of an ability card. Alternatively, the A, B, C, D and E levels of interest rate can be set depending on local financial status.

6). Opportunity and Luck

A player may draw a mixing happy card, opportunity card, or a society card and obtaining the opportunity of lottery, job change, shopping, venture opportunity, real estate opportunity, investment market, preferential loans, and salary increase. This event is independent of economical circulation.

7). Accounts Payable

This comprises loans, insurance, investments, lending, corporate accounts payable, and court rulings etc.

8). Calculation

Each player is required to fill the following statements, etc. depending on game levels: Statement of cash flows, investment report, balance sheet, energy development table, corporate financial report, personal bank account and risk management, and target set table, personality analysis table, and success program.

9). Year-end performance-related pay

Year-end performance-related pay will be drawn by the financial center and distributed to each player as year-end performance-related pay which is subject to variations depending on business leading indicator, occupation and given energy card.

At the start of each year prior to paying salary, each player may use an energy element card to reset living expenses and three energy element cards to draw a new job from an occupation card. The player may use another three energy element cards to draw a new job from the occupation card if he/she is not satisfied with the job. Any drawn job will be removed from a next drawing. At most three times of drawing are allowed. No experience and experienced fields will be shown on the drawn job. No experience, experience time and required energy element cards are shown on the occupation card.

10). Annual salary is given by cash or record on the statement of cash flows after deducting fixed expenditure.

Learning topic will be discussed immediately after the game ends. The topic comprise statement of cash flows, investment report, balance sheet, energy development table, corporate financial report, personal bank account and risk management, target set table, personality analysis table, and success program. Additional items may be added depending on specific learning topic.

The card game for learning and practicing experience elements to players for the models of behavioral and financial success of the invention can be implemented by computer or cards. For example, one or more players may use a personal computer to play the card game after connecting to the Internet. The card game may be a group card game. The card game may be an interactive learning game as a TV program. All controlled or uncontrolled events and situations happened in real life can be simulated by the invention. Thus, by learning and practicing experience elements of life events players may have positive behavior mode and thinking mode toward success.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A card game system for learning and practicing experience elements to players for the models of behavioral and financial success, comprising: a computer configured to implement the following card game instructions: providing a financial center as an operating center of the card game for setting initial conditions of each player, setting playing time, setting economic market status, setting final target, calculating tables and lists, setting financial markets, setting consumer markets, issuing payment, and issuing year-end performance-related pay; a plurality of simulated life event cards including events related to at least health, society, career, and wealth, the events being either independent or affecting one another, the event being a simulated event about daily life, and the event being adapted to set payment and earning of each player when playing the card game wherein the life event cards are randomly issued to the players when the card game begins, one player can execute any life event card of himself, and the other players can join the executed life event card or not that may change the financial status of those following players; a plurality of different variable element cards each for changing the life event card from players, the variable element card adapted to change, exchange, and replace the life event cards of the players, and change required payments and earning of the life event cards wherein the variable element cards and the life event cards are mixed and randomly distributed to each player when the card game begins, one player can execute any variable element card for change, and the other players have to execute events given by the executed variable element card and change the life event cards or combine the life event cards of the players; a plurality of different energy element cards each corresponding to the required payment and earning of the life event card wherein a set of the energy element cards are distributed to each player when the card game begins, and each player can execute any event by sending or receiving the energy element card; and a plurality of different game recordation and learning reports generated by the player executing the life event card, paying the required payment, and obtaining the earning wherein the player can declare a qualifier by reaching a qualified target, any qualifier who self-confident become the winner can declare a state of entering the final decisive contest to 5 challenge the champion and announce how many cycles the competition ended simultaneously, the final competition period should not be less than three times cycling trough the financial center and the game will be finished after these cycles, scores of all players will be calculated after ending with a genuine winner being declared thereafter, and the winner is not only a qualifier but also the genuine victor.

2. The card game as recited in claim 1, wherein the life event cards comprise (a) events related to life, athletics, entertainment, literature, accident, and risk of health; (b) events related to homogeneity, behavior, activities, society, accident, and risk of society; (c) events related to ability, job, business, opportunity, accident, and risk of career; and (d) events related to wealth, investment and luck, enjoyment, property, quality, accident, and risk of wealth.

3. The card game as recited in claim 1, wherein the variable element cards comprise an opportunity variable element card for changing a life event card form players; a transfer card for allowing all player to transfer life event cards by rules; a power and influence card for allowing one player to check cards owned by the other players and take out one card from one of the other players, the power and influence card being a "must" of the life event card; a destiny card for allowing one player to take out a card from the remaining life event cards not given to the players, the destiny card being a "no control" card required to execute immediately without delay; not only one solution card for solving problems by asking the financial center or the player; a really lucky card to be chosen from the remaining life event cards not given to the players, the really lucky card being adapted to exchange with any cards not wanted by a player; an exchange card for allowing all player to exchange an unwanted life event card with next player mutually; a double repayment card being positive and negative selections for increasing effects of good and bad events respectively, the double repayment card being adapted to double the payment or the earning; and a help card for helping other players in need.

4. The card game as recited in claim 1, wherein the energy element cards comprise environment energy element cards for interacting with the environment, self energy cards for learning and management developing integration and innovation, dynamic energy element cards for changing speed of life events, and opportunity energy cards for competing and taking opportunities by obtaining, negotiating, or communicating.

5. The card game as recited in claim 4, wherein the environment energy element cards comprise selection cards for representing obtainment or rejection, opportunity cards for representing chasing and control, ability cards for representing ability promotion and enhancement, quality cards for representing enjoyment and innovation, supporter cards for representing support and help, and thanks giving cards for representing acknowledgement and preciousness.

6. The card game as recited in claim 4, wherein the self energy cards comprise learning cards for representing self growth, management cards for representing ability of managing learning result, integration cards for representing progress after the management, and innovation cards for representing differences made after the integration, and wherein the self energy cards are derived from the environment energy element cards and are sequentially obtained.

7. The card game as recited in claim 4, wherein the dynamic energy element cards comprise positive cards for representing desire, chasing cards for representing fervor, target card for representing target, competition cards for representing competition and challenge, help cards for representing asking help, and risk cards for representing challenge in a risky environment.

8. The card game as recited in claim 4, wherein the opportunity energy element cards comprise, sequentially, want cards for representing a player wanting another player to share or assign a life event card when seeing an opportunity, must cards for representing requesting another player to transfer his or her life event card, and bidding cards for representing requesting another player to bid investment or business; wherein the bidding card has a higher priority than the must card and the must card priority than the want card when the players are playing the opportunity energy element cards at the same; and wherein the highest priority will be decided by bidding if more than two players play the same cards at the same time.

9. The card game as recited in claim 1, wherein the game recordation report and learning reports comprise a statement of cash flows, an investment statement, an asset and liability state, an energy development table, a corporate financial report, a personal bank balance statement, a risk management, a target set dream table, a personality analysis, and a success program.

10. The card game as recited in claim 1, wherein the financial center can declare the market status having:

(A) a current market value wherein different risks can be shown by adding plus or minus percentage of market value to initial value, the accumulated value is taken as the current market value and is represented by different colors each being associated with a digit representing degree of risk;

(B) an economical circulation wherein an economical digit machine can randomly show a positive or negative integer for representing economical boom or bust, and wherein the positive integer means economic is growing and the negative integer means economic is in recession, or the economical circulation is represented by the current market value and represented by digits; and (C) a risk coefficient representing corresponding coefficient of one of different financial products or businesses wherein the risk coefficient is subject to market variations and can be obtained by simulating real market;

wherein each financial product can be expressed by (A)×(B)×(C) which is equal to up or down percentage of the financial product of current year so that risks of different financial products can be represented by a three-dimensional structure to enable the players to easily learn variation models of a real financial market.

* * * * *

UNITED STATES PATENT AND TRADEMARK OFFICE

CERTIFICATE OF CORRECTION

PATENT NO. : 8,297,621 B1
APPLICATION NO. : 13/162723
DATED : October 30, 2012
INVENTOR(S) : Shu Hua Chao et al.

It is certified that error appears in the above-identified patent and that said Letters Patent is hereby corrected as shown below:

On The Title Page, Item (73) Assignee: "Chung Hua University, Hsinchu (TW)"

should be DELETED

Signed and Sealed this
Twenty-eighth Day of April, 2015

Michelle K. Lee

Michelle K. Lee
*Director of the United States Patent and Trademark Office*